US006251186B1

(12) United States Patent
Vaccani

(10) Patent No.: US 6,251,186 B1
(45) Date of Patent: Jun. 26, 2001

(54) MACHINE FOR APPLYING ADHESIVE TO PRESET REGIONS OF PRODUCTS IN GENERAL

(76) Inventor: Lucio Vaccani, Via Capodistria 21, 23900 Lecco (IT)

( * ) Notice: Subject to any disclaimer, the term of this patent is extended or adjusted under 35 U.S.C. 154(b) by 0 days.

(21) Appl. No.: 09/409,397

(22) Filed: Sep. 30, 1999

(30) Foreign Application Priority Data

Oct. 7, 1998 (IT) ..... MI98A2159

(51) Int. Cl.[7] ..... B05C 5/00

(52) U.S. Cl. ..... 118/681; 118/679; 118/713; 156/64; 156/356

(58) Field of Search ..... 156/64, 356, 360, 156/357, 378, 546; 118/704, 680, 682, 713; 12/1 A, 1 W, 142 F, 142 RS, 142 T; 36/19.5, DIG. 1; 239/8

(56) References Cited

U.S. PATENT DOCUMENTS 3,568,638 * 3/1971 Isaac ..... 118/323
4,642,975 * 2/1987 Langen et al. ..... 53/564
4,815,660 * 3/1989 Boger ..... 239/8
5,114,267 * 5/1992 Smith et al. ..... 404/83
5,807,449 * 9/1998 Hooker et al. ..... 156/64

* cited by examiner

*Primary Examiner*—Richard Crispino
*Assistant Examiner*—Yewebdar T. Tadesse
(74) *Attorney, Agent, or Firm*—Guido Modiano; Albert Josif; Daniel O'Byrne

(57) ABSTRACT

A machine for applying adhesive to preset regions of products in general, particularly soles for shoes, comprising a conveyor for continuously moving individual products to be glued, a three-dimensional vision unit for acquiring a spatial shape of each individual product in transit, a first gluing head, which is driven by the vision unit to apply adhesive to a first portion of the product in transit, and at least one second gluing head, which is driven by the vision unit to apply the adhesive to a second portion of the product in transit which is different from the first portion.

18 Claims, 5 Drawing Sheets

MACHINE FOR APPLYING ADHESIVE TO PRESET REGIONS OF PRODUCTS IN GENERAL

BACKGROUND OF THE INVENTION

The present invention relates to a machine for applying adhesive to preset regions of products in general, particularly soles for shoes. In many industrial fields, and particularly in the field of shoes, there is the need to be able to apply to preset regions, i.e., at the upper edge of the sole in the case of shoes, a band of adhesive so as to bond the upper of the shoe.

The solutions of the prior art substantially provide for a machine in which the perimetric shape of the sole is acquired and then stored in a programmable processing unit, which drives a dispensing unit below which the sole is conveyed. During the application of the adhesive, the sole stationary and the dispensing unit is moved along two perpendicular directions on a plane, so that the dispensing nozzle can discharge, along a closed path, a jet of adhesive in a direction which is substantially perpendicular to the plane of arrangement of the sole.

This type of apparatus yields satisfactory results in the case of substantially flat soles which have no welt, but it is fully unsuitable in the case of contoured soles, soles with a welt and particularly so-called box soles, i.e., more generally, all soles with contours which form raised portions or have a peripheral region which lies on a plane other than the horizontal plane, so that acquiring the perimetric contour of the sole is not sufficient to allow easy application of the adhesive in the preselected regions. In the current situation, after the acquisition unit has acquired the images, it is necessary to perform considerable corrections in order to reconstruct an acceptable path for the movement of the nozzle, since the acquisition of the contour of the sole against a backlight can provide only partial information which is not sufficient to define a path in space.

Another drawback of the solutions of the prior art is the fact that since the adhesive has to be applied while the sole is stationary, the operating times are relatively long.

SUMMARY OF THE INVENTION

The aim of the present invention is to solve the above-cited problems, by providing a machine for applying adhesives to preset regions of products in general, particularly shoe soles, which allows to automatically apply a band of adhesive to shaped soles and allows to affect, with the adhesive, also surfaces which are not predominantly arranged on a horizontal plane.

Within the scope of this aim, a particular object of the present invention is to provide a machine in which it is possible to process so-called box soles while still obtaining a precise acquisition of the shape of the product being acquired, with a consequent precise definition of the actuation of the units meant to dispense adhesive.

Another object of the present invention is to provide a machine which allows to drastically reduce working times, since the sole is not stopped even during the adhesive application step.

Another object of the present invention is to provide a machine for applying adhesive in preset regions of products in general, particularly soles for shoes, which thanks to its particular constructive characteristics is capable of giving the greatest assurances of reliability and safety in use.

Another object of the present invention is to provide a machine which can be easily obtained starting from commonly commercially available elements and materials and is also competitive from a merely economical point of view.

This aim, these objects and others which will become apparent hereinafter are achieved by a machine for applying adhesive to preset regions of products in general, particularly soles for shoes, according to the invention, characterized in that it comprises a conveyor for continuously moving individual products to be glued, a three-dimensional vision unit for acquiring the spatial shape of each individual product in transit, a first gluing head, which is driven by said vision unit to apply the adhesive to a first portion of said product in transit, and at least one second gluing head, which is driven by said vision unit to apply the adhesive to a second portion of said product in transit which is different from said first portion.

BRIEF DESCRIPTION OF THE DRAWINGS

Further characteristics and advantages of the present invention will become apparent from the following detailed description of a preferred but not exclusive embodiment of a machine for. applying adhesive to preset regions of products in general, particularly soles of shoes, illustrated only by way of non-limitative example in the accompanying drawings, wherein:

FIGS. 5*a* to 5*i* and 5*b* to 5*n* illustrate sequentially the movement of the gluing head for following the various regions of a sole of a shoe;

DESCRIPTION OF THE PREFERRED EMBODIMENTS

Figure 1:
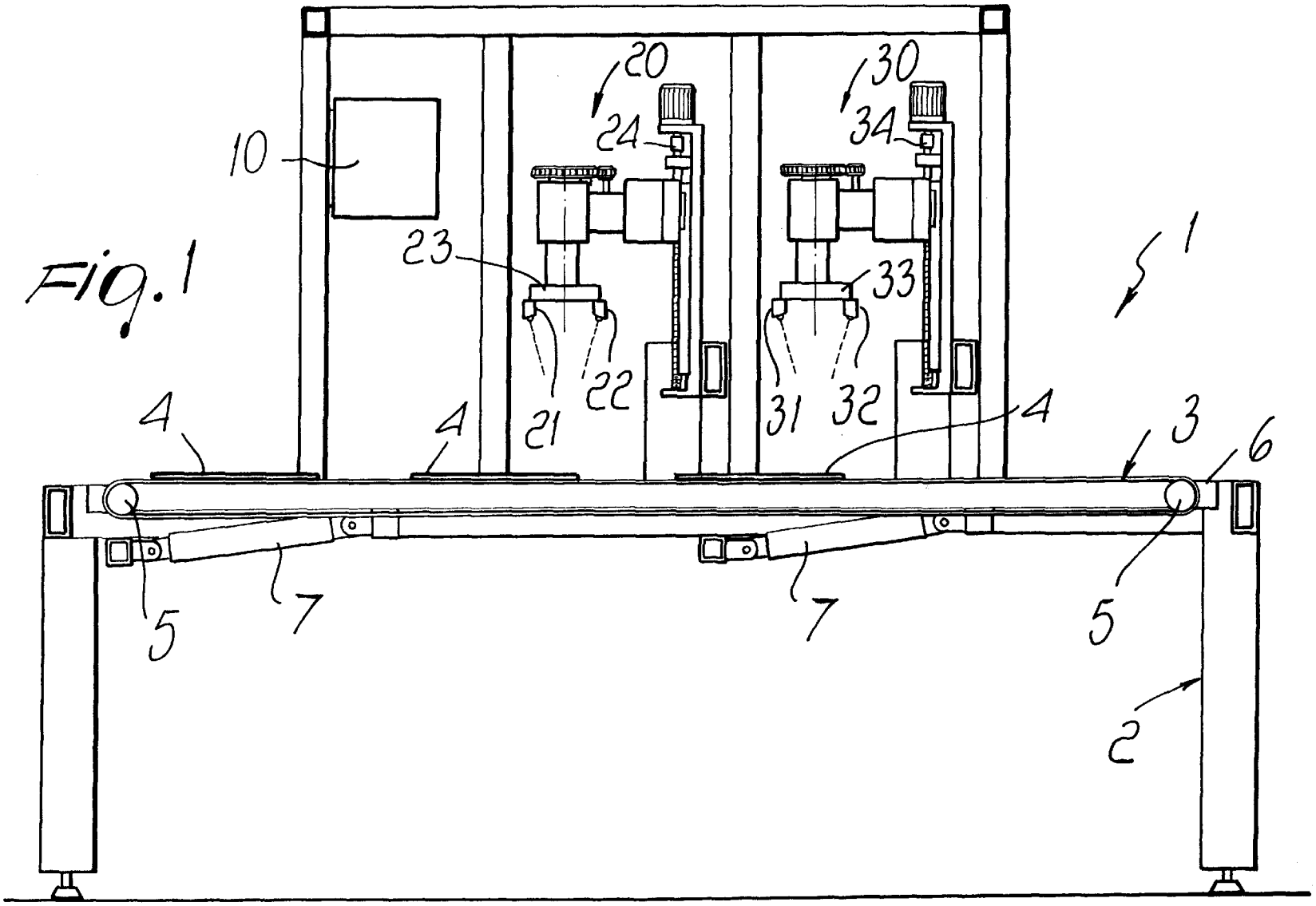
FIG. 1 is a schematic side elevation view of the machine according to the invention.
Figure 2:
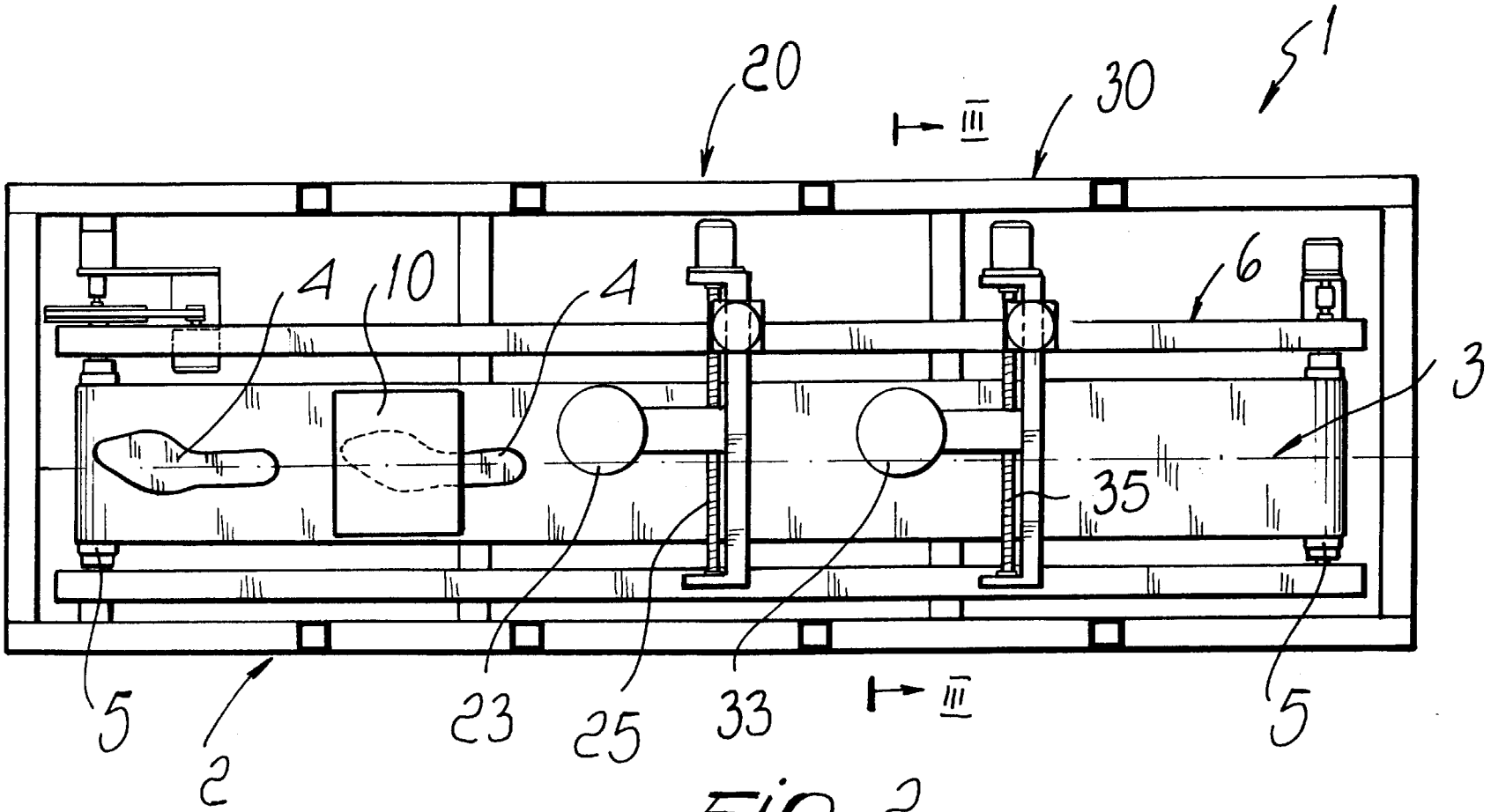
FIG. 2 is a top plan view of the machine.
Figure 3:
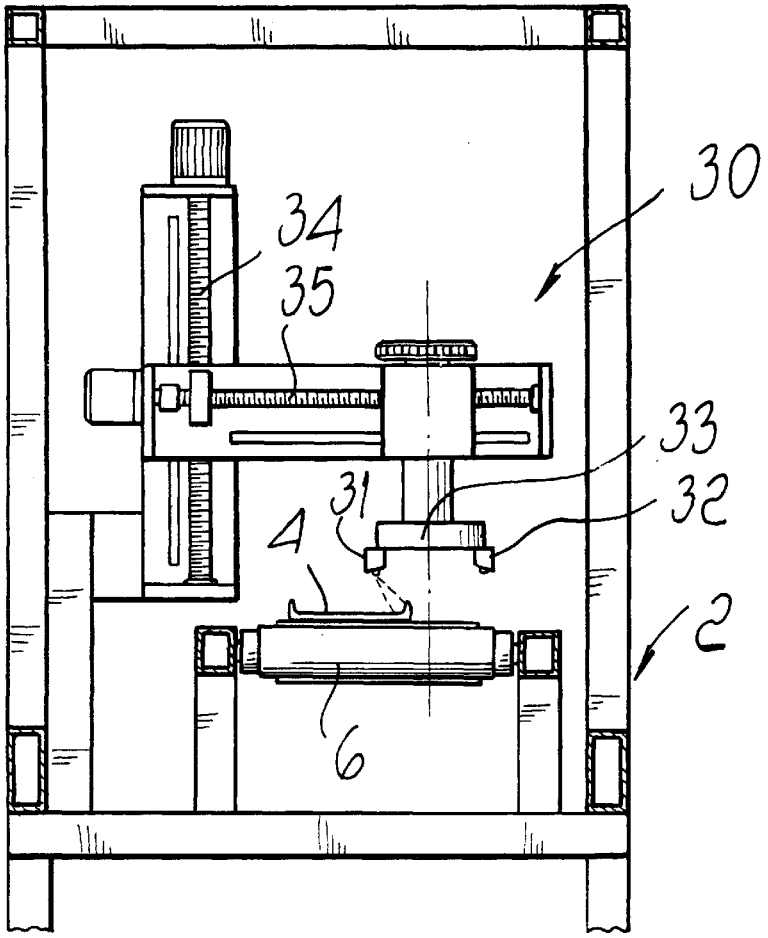
FIG. 3 is a schematic sectional view, taken along the line III—III of FIG. 2.

With reference to the above figures, the machine for applying adhesive to preset regions of products in general, particularly soles for shoes, according to the invention, which is generally designated by the reference numeral 1, comprises a base framework 2 on which a conveyor 3 is provided for continuously moving the individual products to be glued, which are constituted, by way of example, by soles for shoes, designated by the reference numeral 4.

The conveyor is constituted by a belt conveyor which winds continuously around rollers 5 supported by a frame 6 which, through the action of height adjustment means, constituted for example by linkages 7, can vary its plane of arrangement as a function of the thickness and type of sole being treated.

Above the conveyor 3, in the initial portion relative to the direction and orientation of the movement of the products or soles 4, there is provided a three-dimensional vision unit 10 for acquiring the spatial shape of each individual product in transit arranged on the conveyor 3.

As the sole advances on the conveyor 3, the vision unit analyzes, at the rate of 50–60 scans per second, the cross-section of the sole, reconstructing its entire shape. The analysis concentrates in particular on the peripheral region of the sole, searching for any welts or reference points from which it is is possible to identify the position of the outer edge and of what will be the band of adhesive, as a function of the width set by the operator or preset by the machine, ultimately in order to determine the path that will have to be followed to dispense the adhesive.

Figure 6:
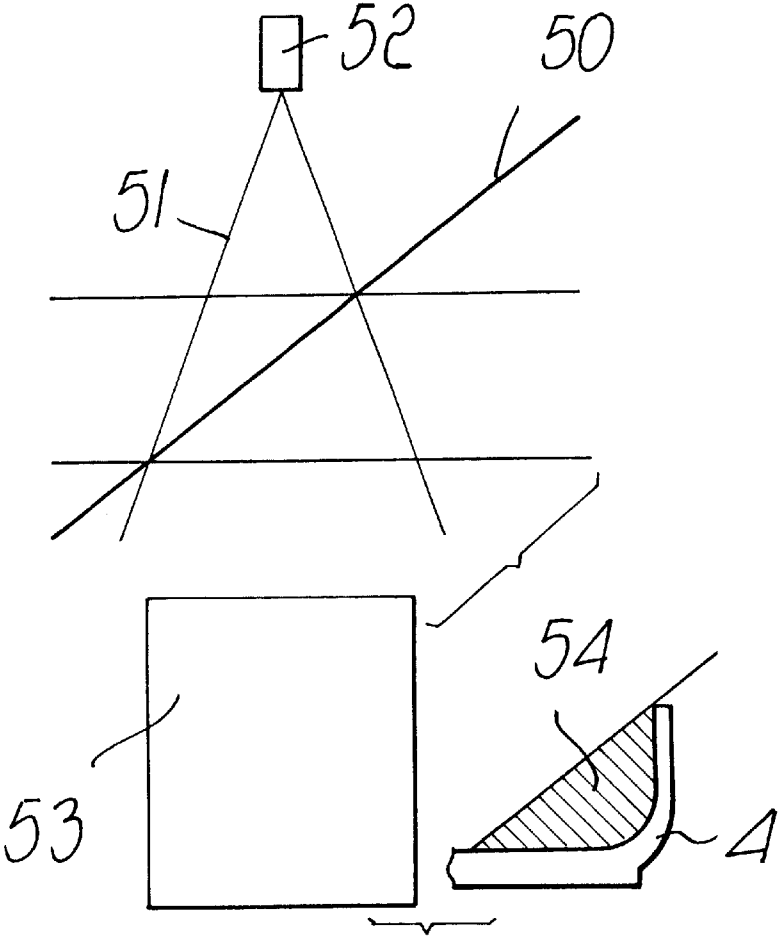
FIG. 6 is a view of the three-dimensions vision unit in a conventional embodiment.

The vision unit has been specifically studied for specific application to products which produce blind spots in the acquisition field; as shown in FIG. 6, which illustrates the prior art, the triangulation performed with the laser blade 50 that intersects the beam 51 emitted by the optical system 52 in fact yields a large work area 53 which produces a relatively large unacquired volume 54.

Figure 7:
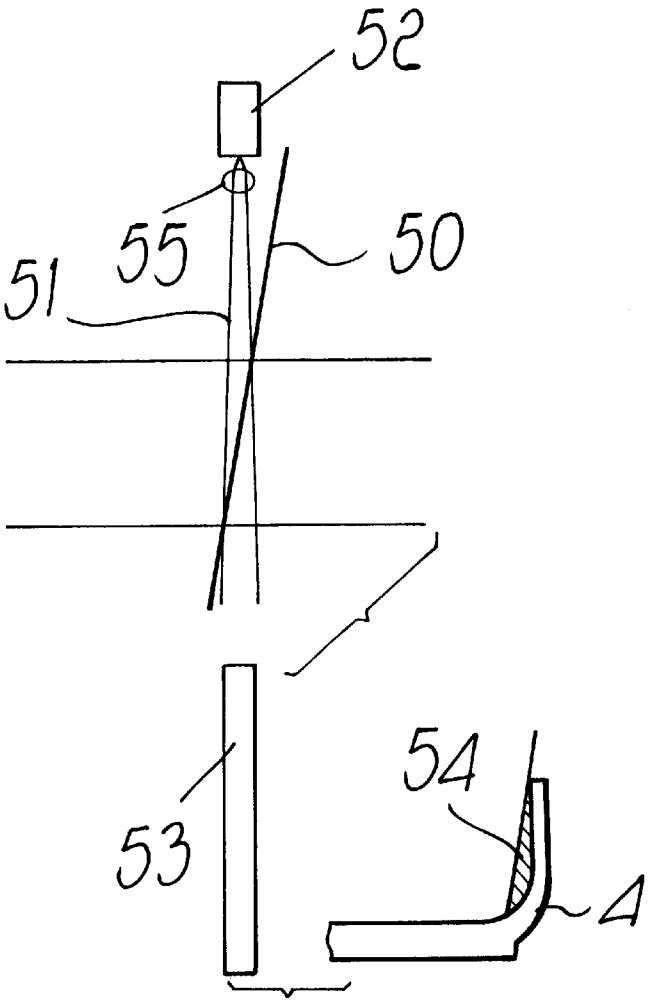
FIG. 7 is a view of the vision unit modified for the specific use.

By interposing a cylindrical lens 55 on the beam 51 so as to narrow said beam 51 (FIG. 7), the two-dimensional ratio of the work area 53 is changed and it is possible to use a laser blade with an inclination which is very close to being vertical, minimizing the unacquired volume 54 and accordingly reducing possible errors due to the reconstruction of the parts that cannot be acquired directly.

The vision unit is connected to a data processing system which, as a function of the spatial shape acquired for the sole, defines the regions of application of the adhesive or glue.

A particular characteristic of the invention resides in the fact that the path for applying the adhesive is determined by the processing unit on the basis of general criteria which are preset and lead to different adhesive application methods.

Downstream of the three-dimensional vision unit with respect to the direction of travel of the soles there is a first gluing head 20, which is driven by the vision unit in order to apply the adhesive to a first portion of the product in transit; downstream of the head 20 there is a second gluing head 30 which is also driven by the vision unit 10 in order to apply the adhesive to a second portion of the product in transit which is different from the first portion.

Both the first head and the second head each support two nozzles, designated respectively by the reference numerals 21, 22 and 31, 32, which are supported by a respective plate 23 and 33 which rotates about an axis which is perpendicular to the plane of arrangement of the soles 4, which corresponds to the conveyance plane.

Moreover each one of the plates 23 and 33 is supported by a transverse translatory motion assembly, provided for example by means of a worm screw 25 and 35 which moves the head in a direction which is substantially perpendicular to the direction of motion of the soles and is parallel to the plane of arrangement of the sole, and by a vertical translatory motion unit 24 and 34, which moves the nozzles at right angles to the plane of arrangement of the soles.

As noted above, each gluing head is equipped with two nozzles which are never simultaneously active. Each nozzle is inclined inward, i.e., toward the rotation axis of the plate 23 or 33, so as to allow to deposit the adhesive on the edge of box soles. Adhesive deposition occurs in a position which lies between the vertical at the nozzle and the rotation axis of the corresponding supporting plate.

During the advancement of the conveyor, the first head 20 deposits the adhesive with one of the nozzles 21, 22, for example on the left part of the sole that passes below it, while the second gluing head 30 performs the application, with the other nozzle 31, 32, on the right part of the sole, thus covering the two portions, which are mutually complementary but different.

The use of two alternative nozzles allows to reduce downtimes, since after applying the adhesive to a first sole which passes below the gluing head the other nozzle is activated and applies the adhesive to the other edge, so that there are no downtimes for the return of the head into the initial position.

The rotation of the nozzle allows to perform uniform deposition of the adhesive in the extreme regions of the sole, where the curvature is considerable, since the rotation of the head that supports the nozzles allows to recover space longitudinally, i.e., in the direction in which the belt travels.

Moreover, the width of the band of adhesive can be kept constant by placing the nozzles at a different distance in the presence of different cross-sections to be glued.

It should be noted that the soles are preferably arranged so that their longitudinal axis is substantially proximate to the direction of motion; in any case, the arrangement of the sole must allow the nozzles to trace a monotonic path, i.e., a path in which each position value of the conveyor is matched by a single point which must be affected by the jet of adhesive.

In practical use, at machine start-up the operator can set a few parameters, such as the distance from the welt, the distance from the edge and the width of the band of deposited adhesive; the sole is arranged substantially longitudinally along the belt and is made to transit below the vision system, which acquires its spatial shape, and is then passed below the first gluing head, which is driven by a step motor and is preferably provided with nozzles of the helical type to produce the spiral deposition of a jet of adhesive, so that the band of adhesive has larger amounts of adhesive at the longitudinal edges.

Figure 4:
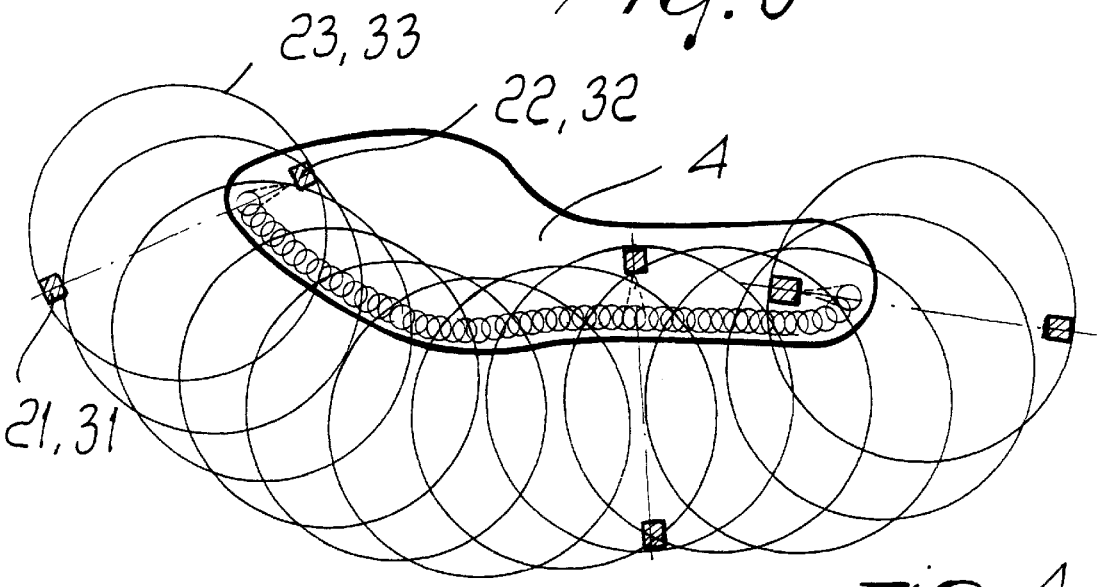
FIG. 4 is a schematic view of the movement of the gluing head with respect to the sole; for the sake of graphic simplicity, the sole is kept stationary and the movements of the head are indicated, although in reality the sole moves continuously on the support.
Figure 5A:
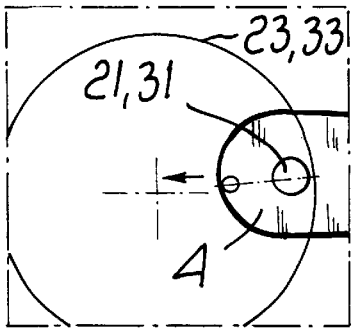
Figure 5B:
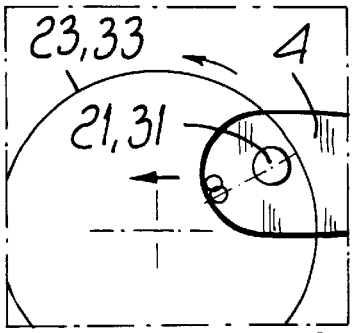
Figure 5C:
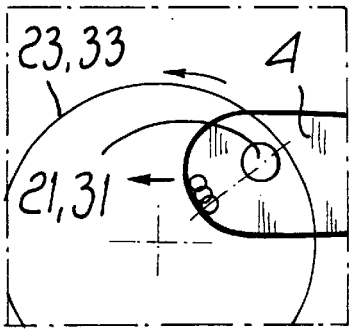
Figure 5D:
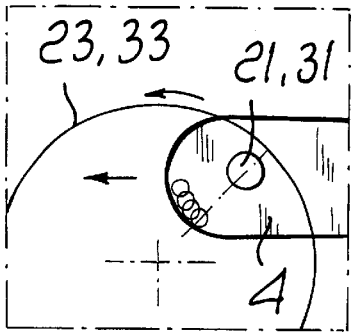
Figure 5E:
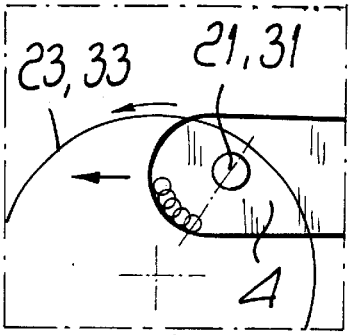
Figure 5F:
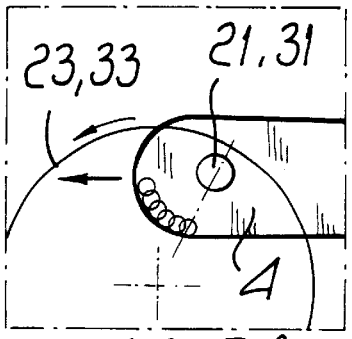
Figure 5G:
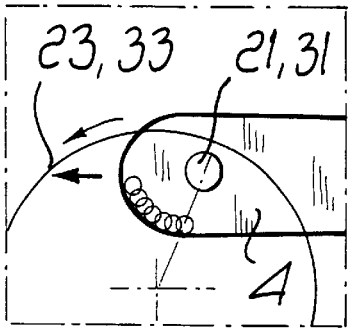
Figure 5H:
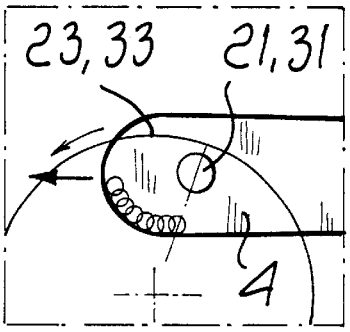
Figure 5I:
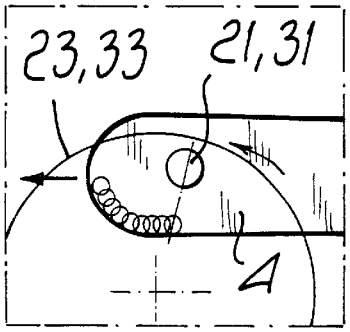
Figure 5L:
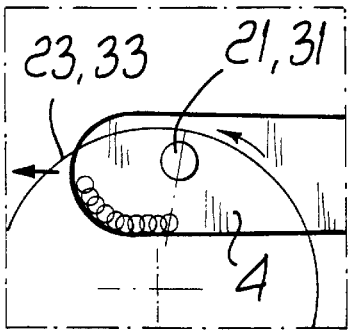
Figure 5M:
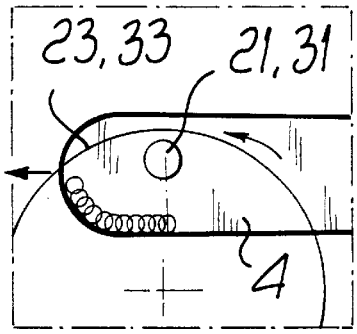
Figure 5N:
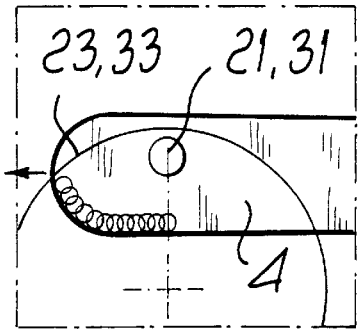

The schematic succession of the rotations of the head is clearly shown in FIGS. 5*a* to 5*n*, whereas FIG. 4 illustrates the overall relative movement of the head and the sole, bearing in mind that for the sake of graphic simplicity the sole has been shown stationary, whereas in reality the sole is subjected to a continuous translatory motion and the head has rotary and translatory motions about a vertical axis and a transverse translatory motion.

After the adhesive has been deposited on a first portion of the sole, for example the left portion, the sole passes below the other gluing head, which completes the application of adhesive to the sole by depositing the adhesive on the other side.

During the application of the band of adhesive, by varying the height of the placement of the nozzles it is possible to maintain a distance between the edges of the band which is always constant and substantially equal to the preset amount.

It should be added to the above that the machine is advantageously provided with a housing, not shown in the drawings, so as to perform the adhesive application process in a tunnel, so that by means of a simple extraction system it is possible to remove any noxious gases produced during this step.

For the sake of completeness in description, it should be noted that the machine can be fitted with any type of nozzle for any kind of adhesive as a function of contingent requirements and that the motors for actuating the various movements of the gluing heads are step motors.

The invention thus conceived is susceptible of numerous modifications and variations, all of which are within the scope of the inventive concept.

All the details may also be replaced with other technically equivalent elements.

In practice, the materials employed, so long as they are compatible with the specific use, as well as the contingent shapes and dimensions, may be any according to requirements.

The disclosures in Italian Patent Application No. MI98A002159 from which this application claims priority are incorporated herein by reference.

What is claimed is:

1. A machine for applying adhesive to preset regions of products in general, comprising a conveyor for continuously moving individual products to be glued, a three-dimensional vision unit for acquiring the spatial shape of each individual product in transit, a first gluing head, which is driven by said vision unit to apply adhesive to a first portion of said product in transit, and at least one second gluing head, which is driven by said vision unit to apply the adhesive to a second portion of said product in transit which is different from said first portion, wherein each one of said first and second gluing heads supports two nozzles which are connected to a plate which rotates about an axis which is substantially perpendicular to a plane of arrangement of said products to be glued, and wherein each one of said plates is supported by means for vertical translatory motion along a direction which is substantially perpendicular to a plane of arrangement of said heads.

2. The machine according to claim 1, wherein said conveyor for continuous movement is supported by means for varying the height of the plane of arrangement on which said products are supported.

3. The machine according to claim 1, wherein said conveyor for continuous movement is constituted by a continuously moving belt.

4. The machine according to claim 1, further comprising a data processing unit which is operatively connected to said vision unit.

5. The machine according to claim 1, wherein said first gluing head is located downstream of said vision unit with respect to a direction of transfer of said products.

6. The machine according to claim 1, further comprising means for the transverse translatory motion of said plates in a direction which is substantially perpendicular to the direction of motion of said products and is parallel to the plane on which said products are supported.

7. The machine according to claim 1, wherein the nozzles supported by each one of said plates are arranged substantially diametrically with respect to each other.

8. The machine according to claim 1, wherein said nozzles have an axis which is inclined, with respect to the vertical, toward said axis of rotation of said plate.

9. The machine according to claim 1, further comprising step motors for the movement of said first and second gluing heads.

10. A machine for applying adhesive to preset regions of products in general, comprising a conveyor for continuously moving individual products to be glued, a three-dimensional vision unit for acquiring the spatial shape of each individual product in transit, a first gluing head, which is driven by said vision unit to apply adhesive to a first portion of said product in transit, and at least one second gluing head, which is driven by said vision unit to apply the adhesive to a second portion of said product in transit which is different from said first portion, wherein each one of said first and second gluing heads supports two nozzles which are connected to a plate which rotates about an axis which is substantially perpendicular to a plane of arrangement of said products to be glued, the machine further comprising means for a transverse translatory motion of said plates in a direction which is substantially perpendicular to the direction of motion of said products and is parallel to the plane of arrangement of said conveyor on which said products are supported.

11. The machine according to claim 10, wherein said conveyor for continuous movement is supported by means for varying the height of said plane of arrangement on which said products are supported.

12. The machine according to claim 10, wherein said conveyor for continuous movement is constituted by a continuously moving belt.

13. The machine according to claim 10, further comprising a data processing unit which is operatively connected to said vision unit.

14. The machine according to claim 10, wherein said first gluing head is located downstream of said vision unit with respect to a direction of transfer of said products.

15. The machine according to claim 10, wherein each one of said plates is supported by means for vertical translatory motion along a direction which is substantially perpendicular to a plane of arrangement of said heads.

16. The machine according to claim 10, wherein the nozzles supported by each one of said plates are arranged substantially diametrically with respect to each other.

17. The machine according to claim 10, wherein said nozzles have an axis which is inclined, with respect to the vertical, toward said axis of rotation of said plate.

18. The machine according to claim 10, further comprising step motors for the movement of said first and second gluing heads.

* * * * *